US006339909B1

(12) United States Patent
Brunnhofer et al.

(10) Patent No.: US 6,339,909 B1
(45) Date of Patent: Jan. 22, 2002

(54) PROFILED SPACERS FOR INSULATION GLAZING ASSEMBLY

(75) Inventors: Erwin Brunnhofer, Fuldabrück; Bernhard Goer, Recklinghausen; Jürgen Regelmann, Witten, all of (DE)

(73) Assignee: Technoform Caprano + Brunnhofer oHG, Fuldabruck (DE)

( * ) Notice: Subject to any disclaimer, the term of this patent is extended or adjusted under 35 U.S.C. 154(b) by 0 days.

(21) Appl. No.: 09/509,173

(22) PCT Filed: Aug. 18, 1998

(86) PCT No.: PCT/DE98/02470

§ 371 Date: Mar. 21, 2000

§ 102(e) Date: Mar. 21, 2000

(87) PCT Pub. No.: WO99/15753

PCT Pub. Date: Apr. 1, 1999

(30) Foreign Application Priority Data

Sep. 25, 1997 (DE) ..... 197 42 531
Feb. 10, 1998 (DE) ..... 198 05 265

(51) Int. Cl.[7] ..... E04C 2/54

(52) U.S. Cl. ..... 52/786.13; 52/788.1; 52/309.14; 428/34

(58) Field of Search ..... 428/34; 52/786.13, 52/788.1, 309.14, 730.4

(56) References Cited

U.S. PATENT DOCUMENTS 4,109,432 A * 8/1978 Pilz ..... 428/34 X
4,113,905 A * 9/1978 Kessler ..... 52/786.13 X
5,079,054 A * 1/1992 Davies ..... 52/786.13 X
5,460,862 A * 10/1995 Roller ..... 52/786.13 X
5,512,341 A * 4/1996 Newby et al. ..... 52/786.13 X
5,962,090 A * 10/1999 Trautz ..... 52/786.13 X
6,061,994 A * 5/2000 Goer et al. ..... 52/786.13
6,192,652 B1 * 2/2001 Goer et al. ..... 52/786.13

FOREIGN PATENT DOCUMENTS

DE 3302659 * 8/1984 ..... 428/34

* cited by examiner

*Primary Examiner*—Laura A. Callo
(74) *Attorney, Agent, or Firm*—Herbert Dubno

(57) ABSTRACT

A spacer profile for a spacer frame to be mounted in an insulating window unit by forming a space between the panes, with a chamber for receiving hygroscopic materials and with at least one contact web to lie against the inner side of a pane, which is connected via a bridge section with the chamber, is characterized i that the profile corpus of the spacer profile consists of an elastically-plastically deformable material with poor heat conductivity, and that at least the contact webs are permanently materially connected with a plastically deformable reinforcement layer.

32 Claims, 8 Drawing Sheets

PROFILED SPACERS FOR INSULATION GLAZING ASSEMBLY

CROSS REFERENCE TO RELATED APPLICATIONS

This application is a national stage of PCT/DE98/02470 filed Aug. 18, 1998 and based upon German national applications 197 42 531.3 of Sep. 25, 1997 and 198 05 265.0 of Feb. 10, 1998 under the International Convention

FIELD OF THE INVENTION

The present invention relates to a spacer profile for a spacer frame to be mounted in the marginal area of an insulating window unit, by forming an intermediate space between the panes, with a chamber for receiving hygroscopic materials and with at least one contact web resting on a pane inside on at least one side of the chamber, which is connected with the chamber via a bridge section.

BACKGROUND OF THE INVENTION

In the sense of the invention, the panes of the insulating window unit are normally glass panes of inorganic or organic glass, without limiting the invention. The panes can be coated or finished in any other way, in order to impart to the insulating window unit special functions, such as increased heat insulating or sound insulating capabilities.

The most important tasks of spacer frames are to space apart the panes of an insulating window units, to insure the mechanical strength of the unit and to protect the space between the panes from external influences. Primarily in insulating window units with high heat insulation, special attention has to be paid to the heat transmission characteristics of the peripheral connection, including the spacer frame and the spacer profiles or frame limbs constituting the same. It has been frequently proven that use of the conventional metallic spacers resulted in a reduction of the heat insulating properties of an insulating window unit. The reduced heat insulation effect appears clearly in the area of the peripheral connection, in the formation of condensation water at the margin of the inner pane at low external temperatures. There are general attempts to eliminate such formation of condensation water even at low external temperatures by keeping the temperature in the area of the peripheral connection at the inner pane as high as possible. Developments in this direction are known under the term of "warm edge" techniques.

In addition to metallic spacer profiles, for quite a long time spacer profiles of plastic materials have been used, thus taking advantage of the low heat conductivity of these materials. However plastic spacer profiles have the disadvantage that they can be bent only with considerable effort or not at all for the production of spacer frames made in one piece. Therefore plastic profiles are cut into straight bars to the size of the respective insulating window unit and interconnected to form a spacer frame by means of several corner brackets. Compared to metal, as a rule such plastic materials also have a low diffusion tightness. Therefore in the case of plastic spacers special measures have to be taken insuring that air humidity existing in the surroundings does not penetrate the intermediate space between the panes to the extent that it depletes the absorption capability of the drying agents normally provided in the spacer profiles, impairing the function of the insulating window unit.

Furthermore a spacer profile has also to prevent the filling gases in the intermediate pane space, such as argon, krypton, xenon, sulfur hexafluoride from escaping. Conversely, nitrogen, oxygen etc. contained in the outer atmosphere should not penetrate the intermediate pane space. Diffusion tightness it applies to vapor diffusion tightness, as well as to gas diffusion tightness for the mentioned gases.

In order to improve the vapor diffusion tightness, DE 33 02 659 A1 proposes to provide a plastic spacer profile with a vapor barrier, by applying a thin metal foil or a metalized plastic foil to the plastic profile on its surface which in assembled state faces away from the space between the panes. This metal foil has to span across the intermediate pane space as completely as possible, insuring the desired vapor barrier effect. The disadvantage here is that the metal foil creates a path of high heat conductivity from one pane of the insulating widow unit to the other. This considerably reduces the effect intended by using a plastic material for the profiles, namely the reduction of heat conductivity of the peripheral connection.

Other spacer profiles, for instance the ones which meet the aforementioned "warm-edge" conditions, use special stainless steels, which in comparison to other metals have a lower heat conductivity, for profile materials. Examples are mentioned in "Glaswelt" 6/1995, pages 152–155. The spacer frames made thereof consist of one piece and are closed at all corners.

A spacer profile of the kind mentioned at the outset is known from DE 78 31 818 U1. The contact webs, there named flanks, to be connected via a sealing adhesive with the panes of the insulating window unit, form the force application points for a specially designed tool fixing the contact webs during bending. The spacer profile is made in one piece of the same material, presumably a metal, which can be bent at right angles obviously only by means of the indicated procedure. Indications as to heat insulation or even measures for improving the heat insulation can not be found in the publication.

OBJECT OF THE INVENTION

It is the object of the present invention to provide a spacer profile which can be produced on a large scale and at low cost, with high heat insulating characteristics, whereby from such a spacer profile it should be possible to make a one-piece spacer frame, so that when cold or only slightly warmed, the profile will be bendable in such a manner as to avoid deformation. The spacer profile should also be advantageously in a position to permit to a limited extent relative motions of the glass panes as a result of inner pressure or shearing strain.

SUMMARY OF THE INVENTION

This object is achieved with a spacer profile in which the profile corpus of the spacer profile is formed by an elastically-plastically deformable material with low heat conductivity and at least the contact web is firmly materially connected with a deformable reinforcement layer.

The profile corpus comprises volumwise the main part of the spacer profile and imparts to the same its cross section profile. It comprises especially the chamber walls, the bridge sections, as well as the contact webs.

Elastically-plastically deformable materials are materials wherein after the bending process elastic restoring forces become active, which is typically the case of plastic materials as to which one part of the bending occurs through a plastic, irreversible deformation.

Plastically deformable materials comprise such materials wherein after deformation practically no elastic restoring forces are active, such as is typical for metals bent beyond their apparent yielding point.

The term "materially connected" means that the profile corpus and the plastically deformable layer are permanently connected to each other, for instance through coextrusion of the profile body with the plastically deformable layer, or by separately laminating the plastically deformable layer on it, optionally by means of a bonding agent, or by similar techniques.

Materials with poor heat conductivity or heat-insulating materials are materials which with respect to metals have a clearly reduced heat conduction value, i.e. heat conduction reduced at least by a factor of 10. The heat conduction values $\lambda$are typically of the order of magnitude of 5 W/(m·K) and below, preferably smaller than 1 W/(m·K) and even more preferred smaller than 0.3 W/(m·K).

Surprisingly it has been found that already by reinforcing only the contact webs of the spacer profile made of elastically-plastically deformable material with a plastically deformable reinforcement layer, a good cold bendability of the profile can be achieved. The so-formed sandwich composite produces a high bending resistance moment with the characteristics of the plastic materials and the profile contour. This however results in higher bending forces, but insures only minimal resilience in the bent state, as well as high corner rigidity and yields stiff, and easy to handle spacer frames. The elastic restoring force of the profile body material can therefore act only minimally.

The layer thickness of the reinforcement layer depends on the properties of the actually used materials of the profile corpus and of the reinforcement layer which have to be selected so that, after a bending process, the desired bend is substantially maintained, which means that after a bending by 90° the resilience amounts in any case only to a few degrees, i.e. a maximum of 10°. The reinforcement layer does not have to be a compact layer, but can have for instance netlike perforations.

Preferably the profile body has at least one U-shaped cross section area open towards the outside, whose flanks are formed by a contact web and the neighboring side wall of the chamber and whose base is formed by the bridge sections connecting the same. "Outside" means in this case the side of the profile body facing away for the space between the panes in assembled state.

Further the flanks of the U-shaped cross section area advantageously have a height which is twice, preferably at least three times and further preferably at least 5 times, the width of the base.

In a particularly preferred embodiment of the invention the reinforcement layer is set on the contact surface of the contact web. The contact surface is the surface of the contact web facing the pane inside in the mounted state.

In a further embodiment the reinforcement layer is set on the chamber-side surface of the contact web opposite to the contact surface.

In each embodiment the reinforcement layer extends normally at least over the greater part of the height of the contact web, as well as over its entire length.

Preferably the profile body is permanently connected with a reinforcement layer extending substantially over its entire width and length.

The invention is based on the finding that, in this case, the reinforcement layer contributes to heat conduction from one pane to the other. However, as a result of the contour of the material with low heat conductivity of the profile corpus indicated by the invention, the path of high heat conductivity created by the reinforcement layer is considerably lengthened by comparison with the conventional profiles, so that the heat insulating properties of an insulating window unit equipped with the spacer profile is considerably improved in the area of the peripheral connection due to the invention.

Preferably, especially when the profile corpus material does not offer sufficient diffusion tightness, the reinforcement layer is made to be diffusion tight, at least in the area of the chamber walls and the bridge section, but normally over its entire surface.

Advantageously the reinforcement layer is arranged on the outside of the profile body, or close to the same at least partially embedded in the profile body. Due to the geometric configuration of the reinforcement layer determined by the profile body, an arc-preserving bending resistance moment results, which contributes to the cold pliability without disturbing deformations.

The bending resistance moment can be increased particularly by arranging the reinforcement layer on the chamber-side surface of the contact web on the outside of the bridge section connected with the contact web, as well as on the outside of the chamber side wall adjacent to the contact web, whereby the reinforcement layer has to be diffusion tight at least in the area of the bridge section and the chamber side wall, when additional steps for diffusion tightness are to be eliminated.

It is particularly preferred when the reinforcement layer extends continuously from the contact surface of the contact web over its chamber-side surface, the outside of the bridge section connected with the contact web, the outside of the adjacent side wall of the chamber, as well as the outside of the outer chamber wall, whereby in this case the reinforcement layer has to be diffusion tight at least in the area of the bridge section and side wall of the chamber. Due to the meandering path of the reinforcement layer in this particularly preferred embodiment, a high arc-preserving bending resistance moment is created. This however has stronger bending forces as a consequence, but in the bent state insures a particularly low resilience and a high degree of corner stiffness. Therefore practically the elastic restoring force of the elastically-plastically deformable materials can not become active.

The spacer profile is easy to manufacture, for instance through an extrusion process. After the application of the reinforcement layer, the frame can be made by cold bending. For this purpose conventional bending equipment without significant modifications can be used. A fixing of the contact webs during bending, as in the prior art, is not necessary within the framework of the invention. After the bending process, the contact webs do not show any disturbing deformations.

Advantageously the chamber is arranged centrally in the spacer profile, whereby on both sides of the chamber at least one contact web is provided. This symmetric design makes a positive contribution to the compensation of relative motions of the panes.

The cross section of the chamber can be substantially polygonal, particularly rectangular or trapezoidal. It is also possible to have corner-free, for instance oval configurations of the chamber cross section. It is self-understood that the concept "chamber" includes, besides closed hollow spaces, also trough-like profile shapes.

According to an advantageous embodiment, in the spacer profile, the bridge section is secured in one corner area of the chamber for the connection of at least one contact web. It is particularly advantageous for the bending behavior and the heat insulation when the bridge section is fastened on a corner close to the space between the panes. However it is also conceivable to arrange the bridge section for the connection of at least one contact web in the middle area of a chamber side wall, which in the mounted state faces the panes of the window unit.

Depending on the individual configuration, it can be equally advantageous to make the height of the contact web greater than, smaller than or substantially equal to the height of the adjoining side of the chamber. In order to insure a large contact surface on the pane, it can be advantageous to allow the contact webs to project as much as possible beyond the chamber. It also can be advantageous to arrange the contact webs parallel to the side wall of the chamber. Shorter contact webs improve the contact between the mechanically stabilizing sealing means to be applied externally and the panes.

It is however also possible to arrange the contact webs at a positive or negative angle to one side wall of the chamber, which can range for instance between −45° to +45°, in relation to the longitudinal median axis of the chamber cross section. This can improve the spring action of the spacer profile, as necessary.

Also the contact webs can have at least one contact rib. Such a contact rib will normally run orthogonally with respect to the contact web, so that in the mounted state a clear space is defined between the contact web and the inside of the pane.

As materials for the reinforcement layer, which preferably has a heat conduction value $\lambda<50$ W/(m·K), metals with poor heat conductivity such as mainly tin plate or stainless steel, have proven to be suitable. These materials can be for instance in the form of foils permanently applied to the profile corpus of the spacer profile by means of a bonding agent or laminated onto the same. The tin plate is a sheet iron with a tin surface coating. Suitable stainless steel types are for instance 4301 or 4310 according to the German steel standards.

It has proven to be advantageous when, with regard to the strength of the bond between the reinforcement layer and the profile body, a peeling value (force/adhesion width) of $\geqq 4$ N/mm at a 180° peeling test exists in the finished product.

The gas and vapor barrier required for the diffusion tightness of the reinforcement layer, in combination with the mechanical behavior sought according to the invention can be achieved when the reinforcement layer using tin plate has a thickness of less than 0.2 mm, preferably 0.13 mm the most. If stainless steel is used, it is possible to have even lesser layer thicknesses, namely less than 0.1 mm, preferably 0.05 mm at the most. The minimal layer thickness should be selected so that the required stiffness of the spacer profile is reached and the diffusion tightness is maintained also after bending, particularly in the bent areas. For the indicated materials a minimal layer thickness of 0.02 mm is required.

Depending on the manner in which the spacer profile is finally integrated in the insulating window unit, it can be advantageous to provide the reinforcement layer on its exposed side sensitive to mechanical and chemical influences at least partially with a protective layer. This can for instance consist of a lacquer or plastic material. It is however also possible to provide the reinforcement layer with a thin layer of the heat-insulating material, respectively the material with poor heat conductivity of the spacer profile and to embed the layer in this material at least in certain areas.

Preferably the path of high heat conductivity formed by the reinforcement layer from one pane to the other is a minimum 1.2 times, preferably more than 1.5 times, preferably more than 2 times, and most preferably up to 4 times the width of the space between the panes.

With regard to the resilience with simultaneous material savings, the spacer profile can be optimized when the clear width between a contact web and the adjacent side wall of the chamber amounts to more than 0.5 mm. Such a minimal distance improves also the bending behavior of the spacer profile and facilitates the insertion of mechanically stabilizing sealing means.

Generally the chamber, bridge section and contact webs are made substantially with the same wall thickness. When it is intended to keep the chamber volume for receiving hygroscopic material as large as possible, then it is possible to reduce the wall thickness of all or only some walls of the chamber.

Suitable heat-insulating materials for the spacer profile have been proven to be thermoplastic synthetic materials with a heat conduction value $\lambda<0.3$ W/(m·K), e.g. polypropylene, polyethylene terephthalate, polyamide or polycarbonate. The plastic material can contain the usual fillers, additives, dyes, agents for UV-protection, etc.

From a spacer profile according to the invention it is simple to produce spacer frames made in one piece for insulating window units, which have to be closed only by one connector. Namely it is possible by using commercially available bending tools to bend the spacer profile into corners, which even in this corner areas are characterized by planar surfaces of the contact webs on the side facing the pane inside in the mounted state. The chamber deformation occurring during bending are absorbed by the space between the chamber side walls and the neighboring contact web. The good pliability of the contact webs, as well as of the spacer profile according to the invention, can be probably explained by the fact that the permanent material bond between the elastically-plastically deformable, heat-insulating material, particularly of synthetic material, and the plastically deformable reinforcement layer, particularly of metal, insures a good balance of forces even during cold bending. However it could still be advantageous to slightly warm the bending point, so that relaxation processes are accelerated. The connector is designed either as a corner connector or, connects as a straight connector the cold-bent spacer profile in a connection area outside the corners, for instance in the middle of a pane edge.

Furthermore the invention comprises an insulating window unit with at least two opposite panes and a spacer frame consisting of a spacer profile as described above, whereby the spacer frame with the panes define an intermediate pane space, wherein the contact webs are bonded substantially over their entire length and height with the inner pane side facing them and wherein the clear space between contact webs and chamber, as well as at least the connection area to the neighboring inner pane side are filled with a mechanically stabilizing sealing material.

According to an advantageous embodiment, in the insulating window unit the mechanically stabilizing sealing material basically fills up entirely the free space to the outer peripheral margin of the window unit. Commercially available insulating glass adhesives based on polysulfide, polyurethane or silicon have proven themselves to be suitable sealing materials. As a diffusion-tight adhesive material for bonding the contact webs with inner pane side for instance a butyl sealing material on a polyisobutylene basis is suitable.

BRIEF DESCRIPTION OF THE DRAWING

The invention is further explained with reference to the drawing. In the drawing.

SPECIFIC DESCRIPTION

FIGS. 1 to 6 and 9 to 13 show cross sectional views of spacer profiles. Normally this cross section does not change over the entire length of a spacer profile, except for the tolerances defined by the manufacturing techniques.

Figure 1:
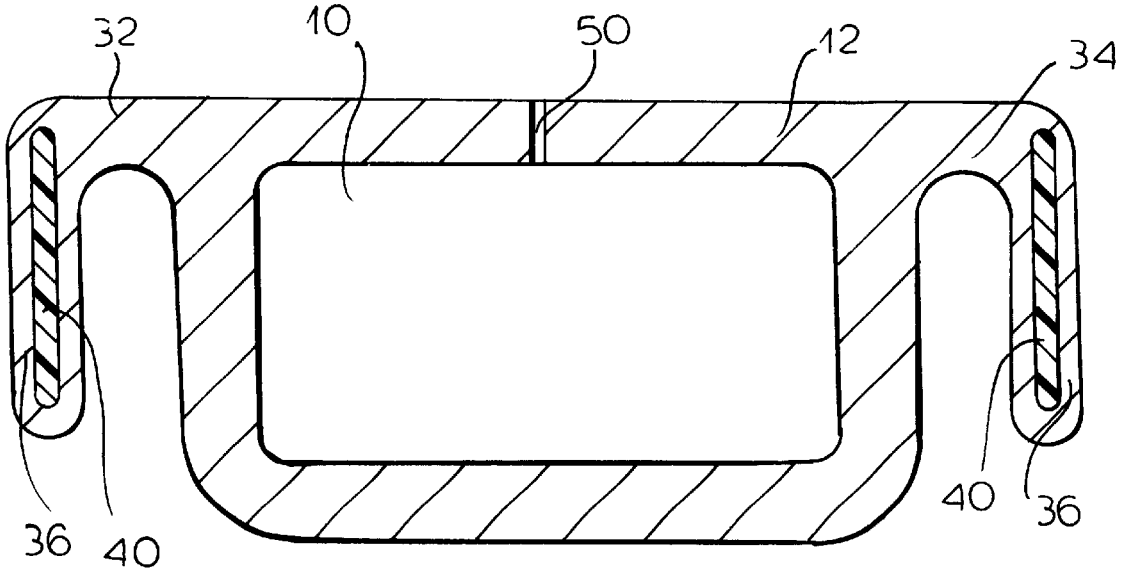
FIG. 1 is a first embodiment of a spacer profile in cross section.

In FIG. 1 a first embodiment of a spacer profile according to the present invention is shown in a cross-sectional view. A chamber 10 with a substantially rectangular cross section is filled with a hygroscopic material not shown in the drawing, for instance a silica gel or molecular sieve, which through slits or perforations 50 which are formed in a wall 12 of the chamber 10, can absorb moisture from the space between the panes. To the corner areas of the wall 12 bridge segments 32 and 34 are connected which continue with the contact webs 30 and 36. These contact webs 30, respectively 36, have a height which is smaller than the height of the neighboring side walls 14, 16 of the chamber, and extend parallel to them. In this embodiment of the spacer profile, all walls, bridge sections and contact webs have approximately the same thickness. The contact webs 30, 36 are a permanently bonded sandwich compound made of the elastically-plastically deformable profile corpus material and of a therein embedded plastically deformable reinforcement layer 40. The bending behavior in the area of the contact webs 30, 36 is already considerably improved due to the arrangement of the reinforcement layer 40, particularly a deformation of the contact webs 30, 36 is avoided during bending. In this variant the material of the profile corpus has to be diffusion-tight. Alternately a diffusion-tight layer is provided, which extends substantially over the entire width and length of the profile.

Figure 2:
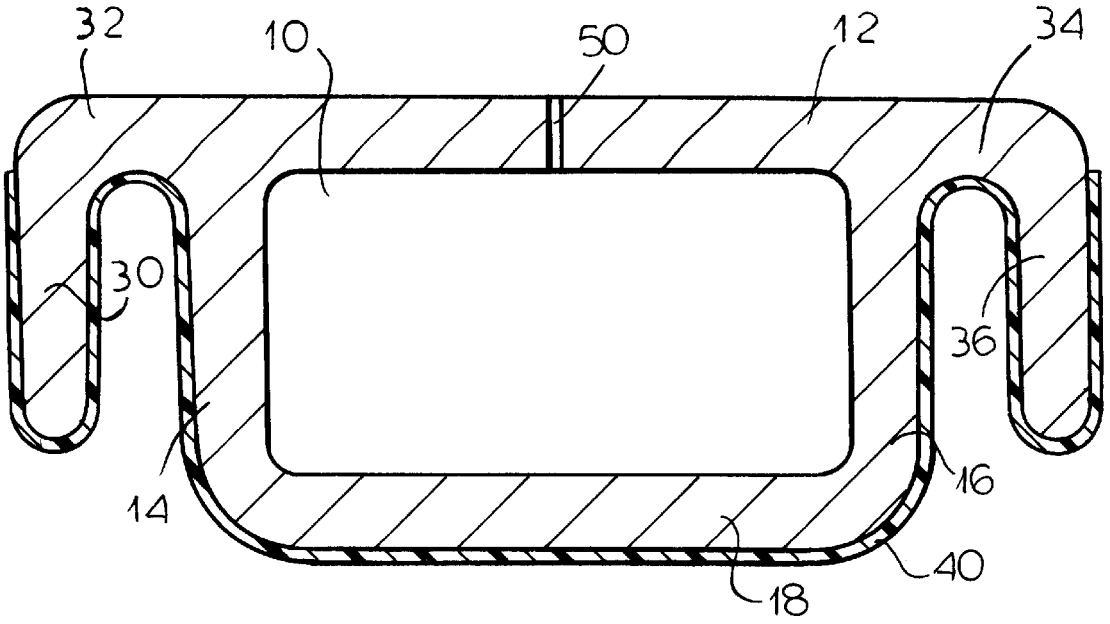
FIG. 2 is a second embodiment of the spacer profile in cross section.

The variant represented in FIG. 2 has a profile body corresponding to FIG. 1. The plastically deformable reinforcement layer 40 is diffusion-tight and provided on the outer side of the profile spacer which in the mounted state faces towards the margin of the insulating window unit. They extend substantially from the contact surface of the first contact web 30 around the same over its chamber-side surface towards the bridge section 32, then around the chamber 10 up to the bridge section 34 and around the contact web 36. The usual mounting manner for such a spacer profile would be so that the wall 12 would face the space between the panes, so that the same would be kept free of moisture by the hygroscopic material inside chamber 10. Due to the fact that the reinforcement layer 40 covers the contact surface of the contact webs 30, 36 a better adhesion capability with the adhesive used later for bonding the spacer profile with the insulating window unit is achieved. Besides the bending behavior in the area of the contact webs is improved due to the basically all-around permanently bonded sandwich compound. The effective heat-conductive path from the closest point to the pane on the side of the first pane to the closest point on the side of the second pane with the mounted spacer profile, i.e. the segments of the reinforcement layer 40 on the contact surfaces of the contact webs 30, 36 do not contribute significantly to the heat-conductive path.

Figure 3:
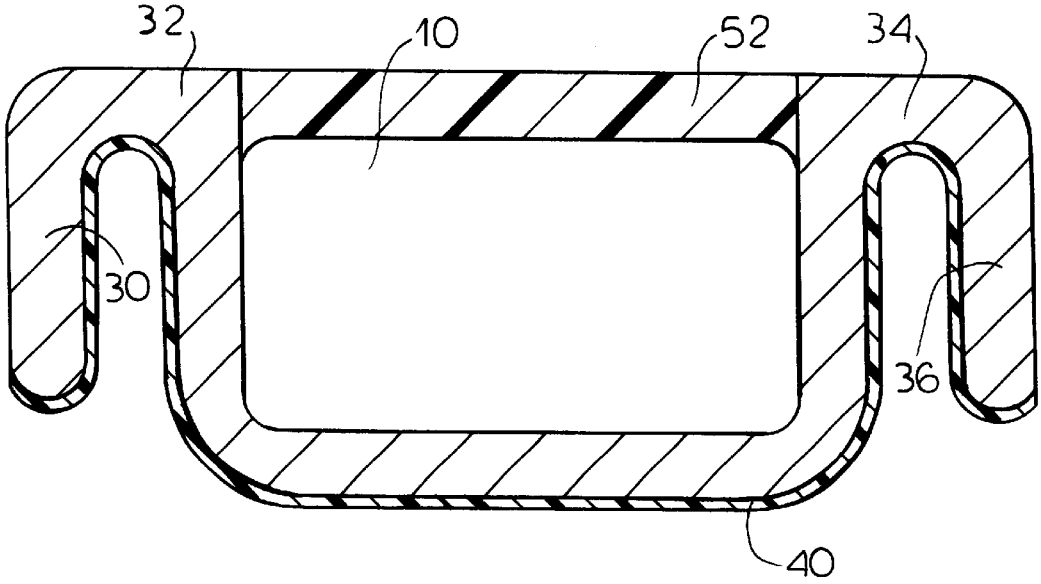
FIG. 3 is a third embodiment of the spacer profile in cross section.

Another variant for the formation of the reinforcement layer 40 is shown in FIG. 3. In this variant the reinforcement layer 40 ends before each of the contact surfaces of the contact webs 30, 36. Further the wall 12 of the chamber 10 from FIG. 1 is practically completely replaced by a porous layer 52, through which the moisture from the space between the panes can enter the chamber 10 and be absorbed by the hygroscopic material.

Figure 4:
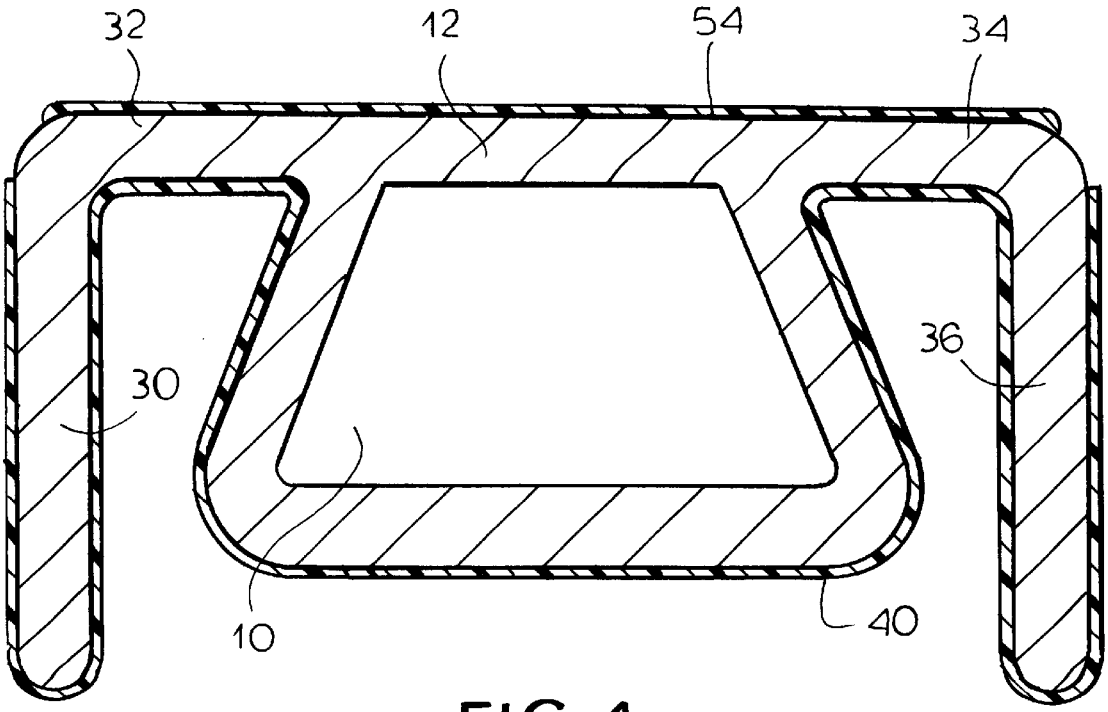
FIG. 4 is a fourth embodiment of the spacer profile in cross section.

In the embodiment of FIG. 4, the contact webs 30 and 36 are prolonged, so that they project beyond the outside of chamber 10, which has a trapezoidal cross section. This results in a further prolonged effective heat-conductive path through the reinforcement layer 40. The trapezoidal configuration of the cross section of chamber 10 increases the clear space between chamber 10 and the contact webs 30, respectively 36, wherein later during the assembly of the insulating window unit additional sealing material can be introduced. On the surface 12 of the chamber 10 facing the space between the panes in the mounted state, a decorative layer 54 is applied, which extends over the bridge sections 32 and 34. Instead of the decorative layer 54, also a layer reflecting heat radiation can be provided. Perforations for access to the inside of chamber 10 are not shown in the drawing.

Figure 5:
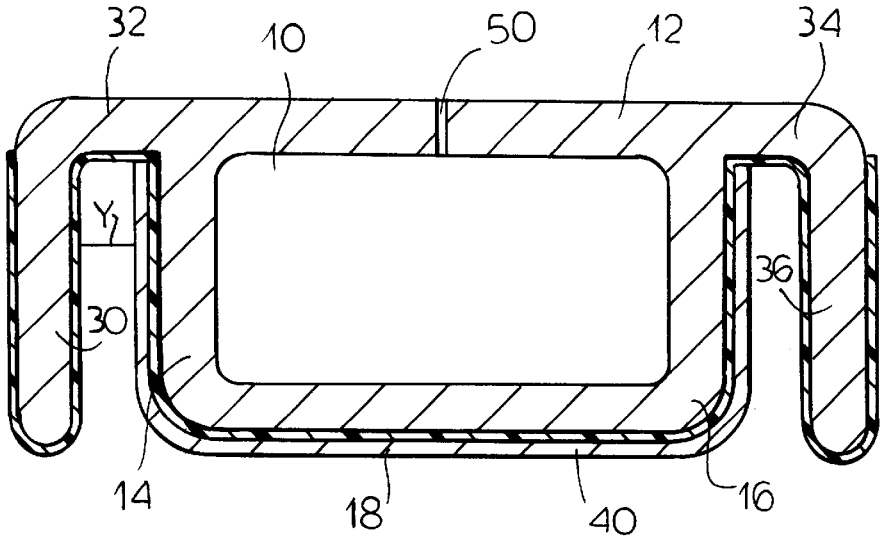
FIG. 5 is a fifth embodiment of the spacer profile in cross section.

In the embodiment according to FIG. 5 the height of the contact webs 30, 36 is selected so that it is basically equal to the height of the respectively neighboring side wall 14, 16 of the chamber 10. By selecting the dimensions of the clear width y between the contact webs 30, 36 and the respectively neighboring side wall 14, 16 of chamber 10, it is possible to determine the spring behavior of the spacer profile, i.e. the elastic behavior with respect to the bending deformation or position changes of the panes of the insulating window unit in the mounted state. Thereby the contact webs 30, 36 can for instance be deformed until they lie against the neighboring chamber wall 14, 16. The reinforcement layer 40 runs around the exposed sides of the contact webs 30, respectively, i.e., covers their contact surfaces and their chamber-side surfaces, but then, after the transition point at the bridge sections 32, respectively 34, it is embedded in the material of the walls 14, 18, 16 of chamber 10. Here an optimal protection of the reinforcement layer is achieved at least in the area of chamber 10.

Figure 6:
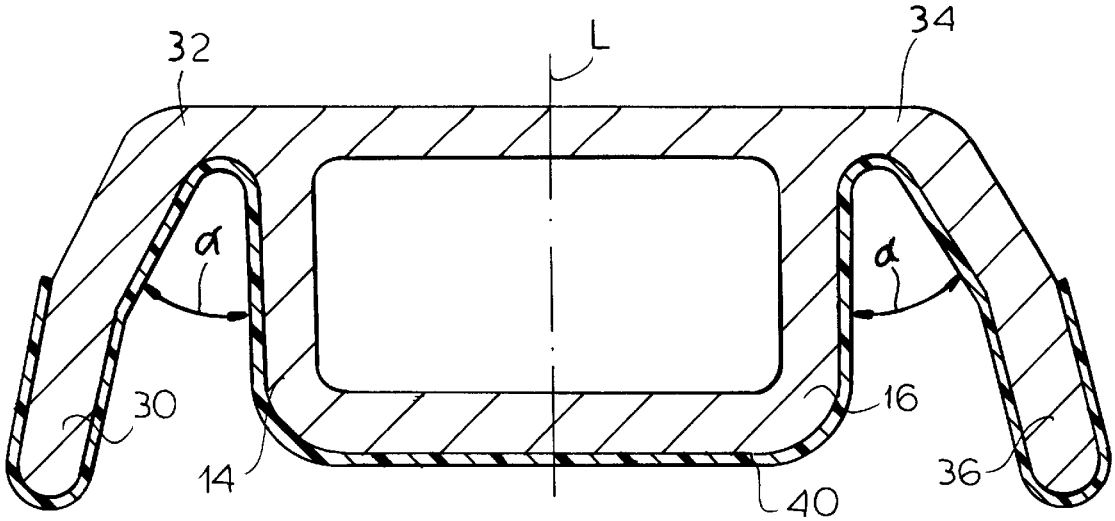
FIG. 6 is a sixth embodiment of the spacer profile in cross section.

The elasticity of the contact webs 30, 36 can also be set when the same, such as in the embodiment example of FIG. 6, do not run parallel to the neighboring chamber walls 14, 16, but under a certain angle $\alpha$ different from zero with respect to the neighboring wall 14, 16 of chamber 10. Thereby the contact webs 30, 36 can also be angled, in order to insure a good contact to the pane inside. This design offers here also the possibility to extend the reinforcement layer 40. The angle $\alpha$ equals here approximately −30° respectively +30° with respect to the longitudinal median axis L of the cross section of chamber 10.

Figure 7:
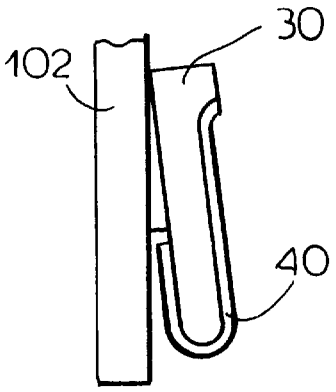
FIG. 7 is a detail view of a spacer profile in contact with a pane of an insulating window unit.

With correspondingly prolonged bridge section, the contact webs can also be arranged at an angle towards the chamber, as shown in the detail view in FIG. 7. Thereby in the mounted state exists a line contact from the contact web 30 to the inner side of a pane 102. Besides the contact web 30 forms an angle $\beta$ which differs from zero with the pane 102. In this embodiment under circumstances the effective path for heat conduction of the diffusion-tight layer 40 is shortened, when the same can not be drawn over the entire contact surface of the contact web 30 facing the pane 102.

Figure 8:
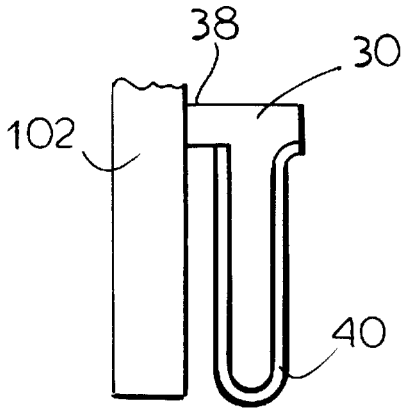
FIG. 8 is a further detail view of a spacer profile in contact with a pane of an insulating window unit.

This drawback is avoided by the embodiment according to FIG. 8, in that at the end of the contact web 30 closest to the bridge section a contact rib 38 is provided. The contact rib 38 lies against the inside of pane 102, the reinforcement layer 40 ends under the contact rib 38. With the contact rib 38 it is possible to set a defined distance between the contact web 30 and the pane 102, thereby setting a defined (minimal) thickness of the intermediate adhesive layer (not shown) between the contact web 30 and the pane 12, this way preventing the adhesive from being pushed out towards thereby between the panes.

Figure 9:
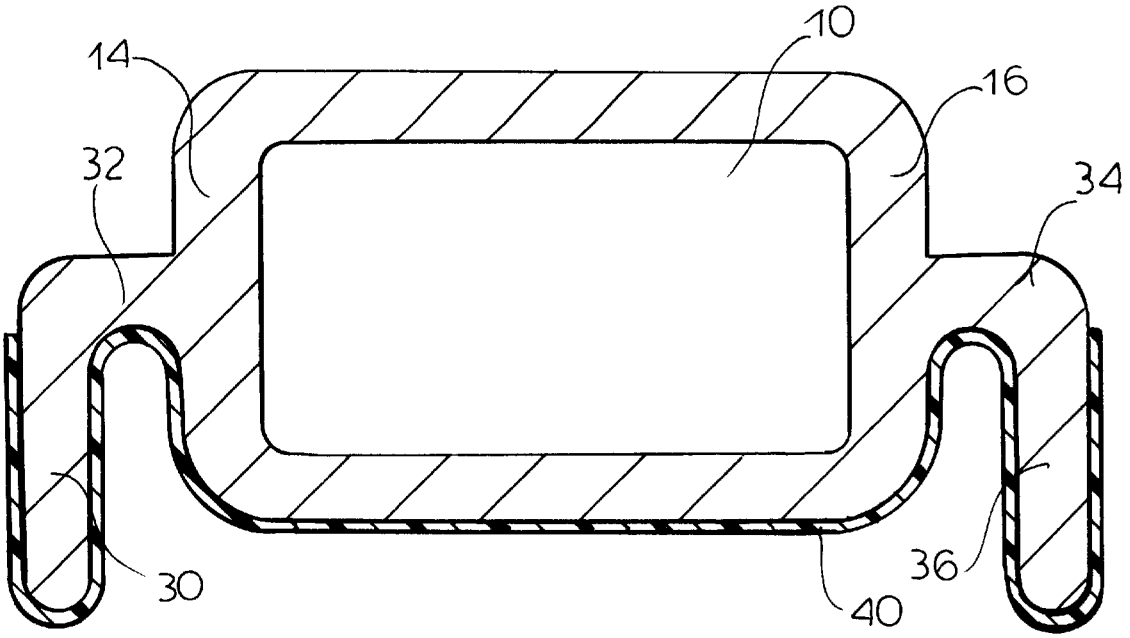
FIG. 9 is seventh embodiment of a spacer profile in cross section.

In FIG. 9 a seventh embodiment of the spacer profile is represented, wherein the bridge sections 32, 34 are basically arranged on a transverse median axis of the chamber cross section and the corresponding contact webs 30, 36 extend beyond the side walls 14. 16 of chamber 10.

Figure 10:
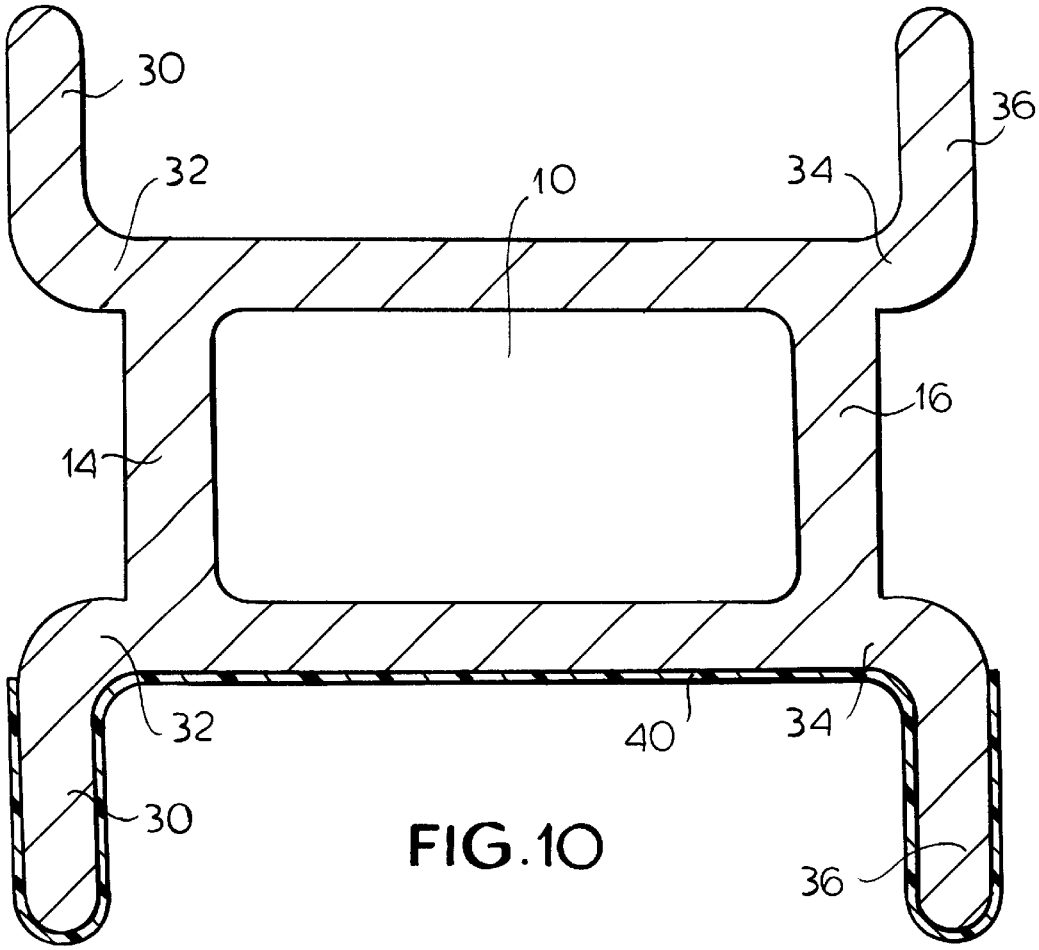
FIG. 10 is an eighth embodiment of a spacer profile in cross section.

A "double-T variant" of the embodiment example of FIG. 9 is represented in FIG. 10. Here the bridge sections 32,34 are again arranged centrally on a side wall 14, 16 of chamber 10, the contact webs 30, respectively 36 extending symmetrically thereto.

Figure 11:
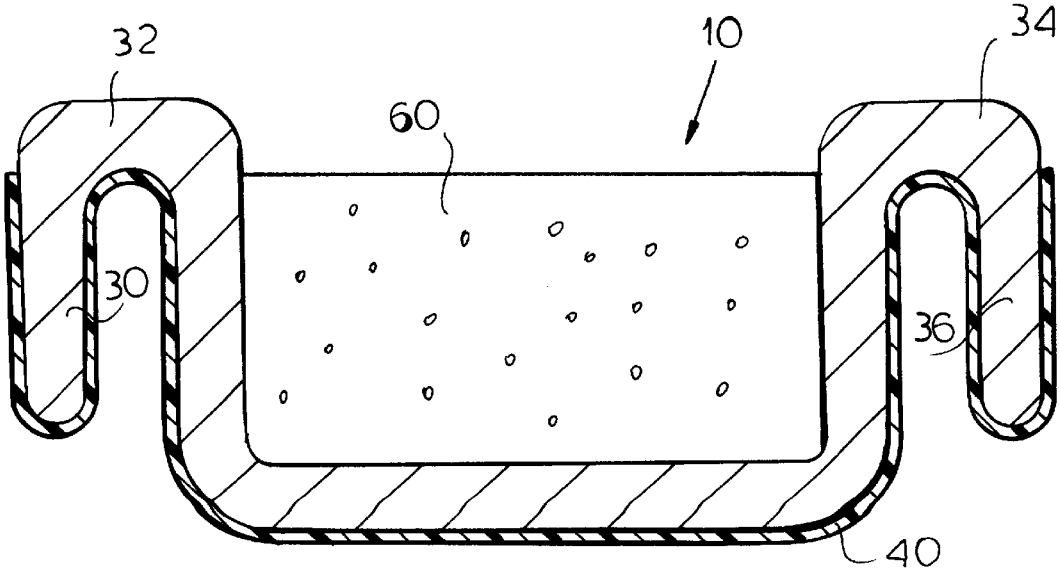
FIG. 11 is a ninth embodiment of a spacer profile in cross section.
Figure 12:
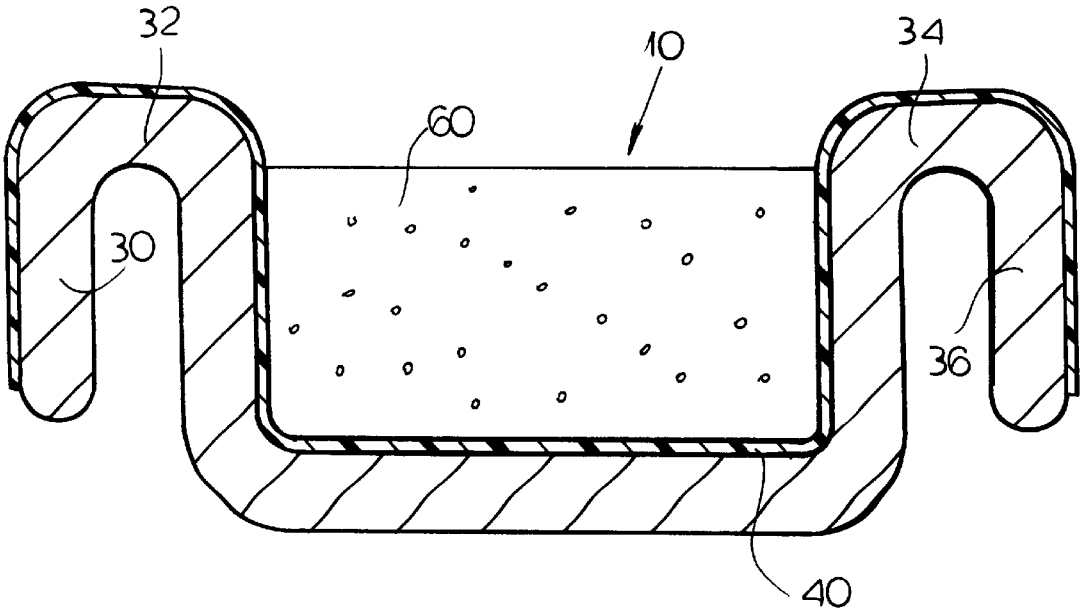
FIG. 12 is a tenth embodiment of a spacer profile in cross section.

The embodiment example of FIG. 11 corresponds to the one of FIG. 2, whereby the chamber wall 12 of FIG. 2 is completely omitted, therefore the chamber 10 being designed as a trough. The hygroscopic material is embedded in a polymer matrix 60, which is held in the chamber 10 by an adhesion. In the modified embodiment of FIG. 11 represented in FIG. 12, the reinforcement layer 40 runs from the contact surfaces of the contact webs 30, 36, over the bridge sections 32, 34 inside the chamber 10, thereby surrounding the hygroscopic material in the polymer matrix 60, which in the mounted state is still open towards the space between the panes.

Figure 13:
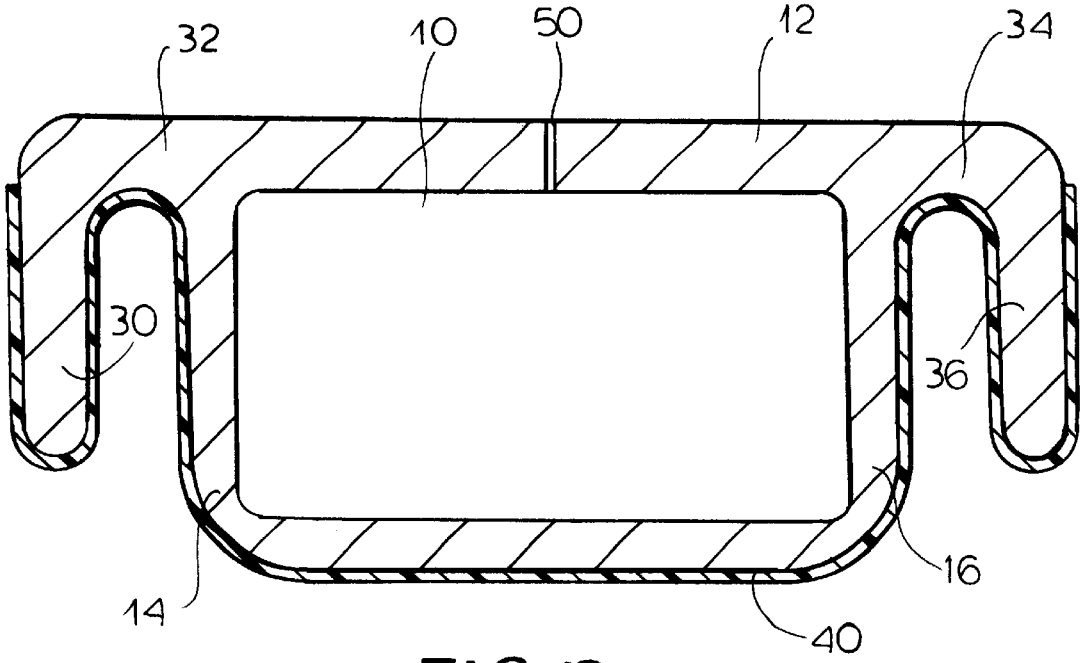
FIG. 13 is an eleventh embodiment of a spacer profile in cross section.

In the embodiment of FIG. 13, the walls 14, 16 and 18 of chamber 10 are made with a slimmer wall thickness than the bridge sections 32, 34, respectively the contact webs 30, 36 and the wall 12. This way more hygroscopic material can be lodged in the chamber 10. When selecting the wall thickness it has to be considered that external forces acting on the panes of the insulating window unit have to be absorbed by the spacer profile, so that the same must have a sufficient buckling resistance (rigidity) against this load over the intermediate pane space.

Figure 14:
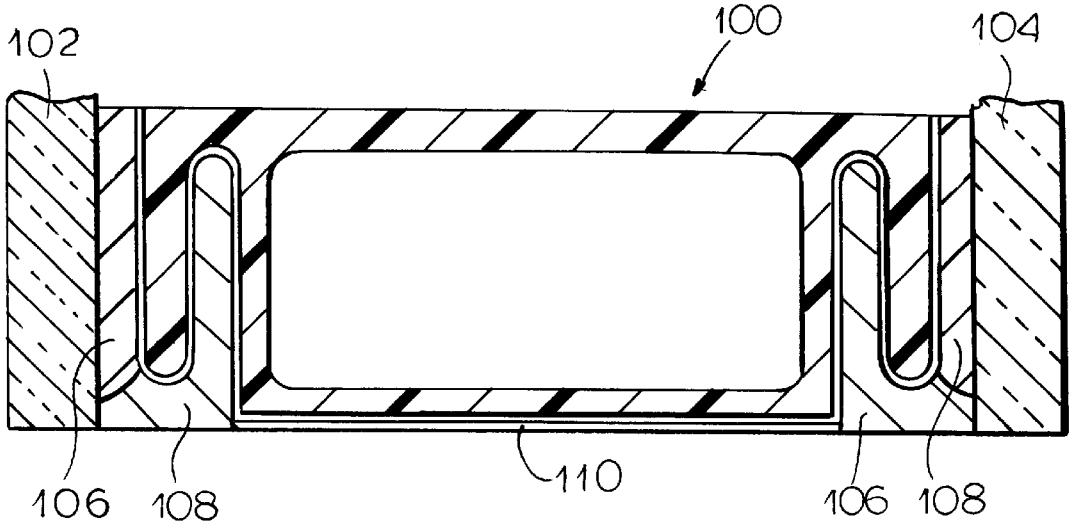
FIG. 14 is a spacer profile in the mounted state in an insulating window unit.
Figure 15:
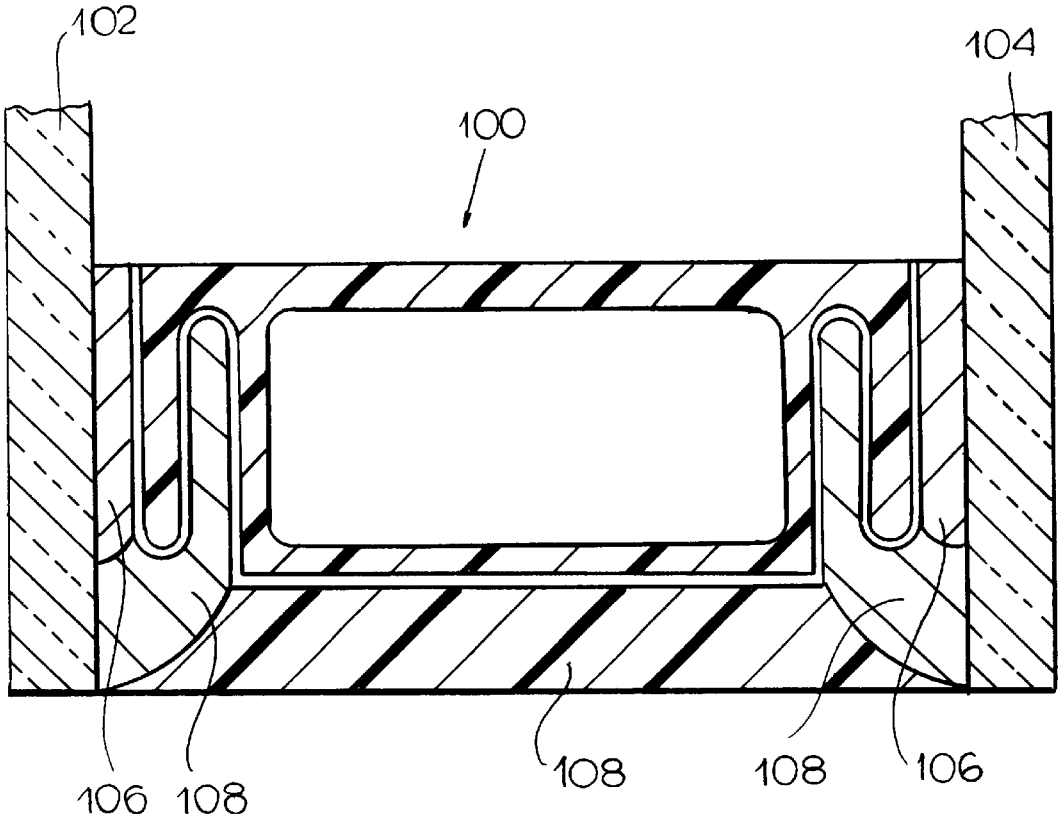
FIG. 15 is a mounting variant for a spacer profile in an insulating window unit.

The spacer profile of the invention can be bent to form a frame and assembled with fittingly cut panes into an insulating window unit. FIGS. 14 and 15 show assembly variants.

In the variant according to FIG. 14 the spacer profile 100 is in contact with one side of the chamber essentially with the outer edges of panes 102, 104. In order to protect the sensitive reinforcement layer 40, the latter is provided on the outside with a protection layer 110 which extends at least so far as to protect the area not covered by adhesives 106, respectively sealing material 108. The spacer profile 100 is affixed at first on the inside of the pane 102, 104 by means of a butyl adhesive 106. The remaining space is afterwards filled with mechanically stabilizing sealing material 108.

The variant according to FIG. 15 offers the possibility of higher mechanical stability and also of improved protection of the reinforcement layer 40 against external influences, in that the spacer profile 100 is offset further towards the pane inside. The mechanically stabilizing sealing material is thereby extended on the pane outer edge at least up to the neighboring pane inside (simply hatched areas of 108 of FIG. 15). It is further preferred to fill completely the clear space between the pane insides and the outside of the spacer profile with mechanically stabilizing sealing material (double-hatched area 108 in FIG. 15).

EXAMPLE 1

As a plastically-elastically deformable, heat-insulating material for the profile corpus according to the embodiment of FIG. 2, polypropylene Novolen 1040K with a wall thickness of 1 mm was used, whereby as a reinforcement layer a tin-plate foil (technical name: andralyt E2, 8/2, 8T57) with a thickness of 0.125 mm was used. The foil was laminated onto the profile corpus.

The chemical composition of this tin plate is: carbon 0.070%, manganese 0.400%, silicon 0.018%, aluminum 0.045%, phosphorus 0.020%, nitrogen 0.007%, the balance being iron. On the sheet iron a tin layer with a weight/surface ratio of 2.8 g/m$^2$ was applied, which corresponds to a thickness of 0.38 $\mu$m.

The finished spacer profile had a width of 15.5 mm including the contact webs and a height of 6.5 mm. The clear width between chamber and contact web, respectively including the tin-plate foil amounted to 4.6 mm. On the one side facing the plastic material the tin-plate foil was provided with a 50 $\mu$m-layer of bonding agent on a basis of polypropylene. The chamber was filled with a conventional drying agent (molecular sieve phonosorb 555 produced by the firm Grace). Towards the space between the panes a two rows of perforations were provided in the chamber wall.

The spacer profile was cut into 6 m long profile rods and then further processed on conventional bending devices. With the aid of an automatic bending machine produced by F.X. BAYER of the type VE spacer frames cut to customized specification were produced, whereby four corners were bent and the connection of the end pieces was performed with a straight connector.

The spacer frame was connected in the usual manner with two correspondingly large float-glass panes to form an insulating window unit. One of the panes was provided with a heat-protective layer with an emittance of 0.1. The insulating window units were filled in a gas-filling press with argon with a content of more than 90% by volume.

The peripheral sealing was performed according to FIG. 15, whereby also the outside of the spacer (particularly the outer wall 18 of the chamber 10, FIG. 2) was covered. As adhesive 106 a butyl sealing material on a polyisobutylene basis was used (width between glass 102 and neighboring contact web: 0.25 mm, height: 4 mm). The remaining clear spaces were filled with a polysulfide adhesive 108, whereby the outer wall coverage of the spacer was 3 mm.

EXAMPLE 2

A spacer profile was produced corresponding to Example 1, whereby however as reinforcement layer a stainless steel foil (type Krupp Verdol Aluchrom I SE) with a thickens of 0.05 mm was used.

The chemical composition of this stainless steel is: chromium 19–21%, carbon maximum 0.03%, manganese maximum 0.50%, silicon maximum 0.60%, aluminum 4.7–5.5%, the balance being iron.

The characteristic values of the materials used in Examples 1 and 2 are comprised in the following Table 1:

TABLE 1

| | tinplate 0.125 μm w/ a 50 μm bonding agent coating andralyt E2, 8/2, 8T57 | stainless steel 0.05 μm Krupp Werdol Aluchrom I SE | polypro pylene Novolen 1040K |
|---|---|---|---|
| E-Module | 200 kN/mm$^2$ | 210 kN/mm$^2$ | 1.9 kN/mm$^2$ |
| tenacity | 350 N/mm$^2$ | 650 N/mm$^2$ | 38 N/mm$^2$ |
| elasticity limit | 280 N/mm$^2$ | 580 N/mm$^2$ | 38 N/mm$^2$ |
| breaking elongation | 15% | 12% | 500% |
| thermal conduction coefficient transverse to rolling direction | 35 W/m K | 13.6 W/m K | 0.15 W/m K |
| extensibility | 0.2% | 0.2% | 7% |

EXAMPLE 3

Figure 16:
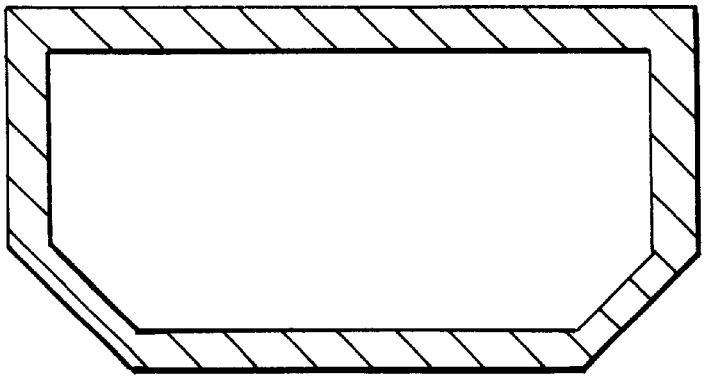
FIG.16 PRIOR ART
FIG. 16 is a spacer profile according to the state of the art in cross section.
Figure 17:
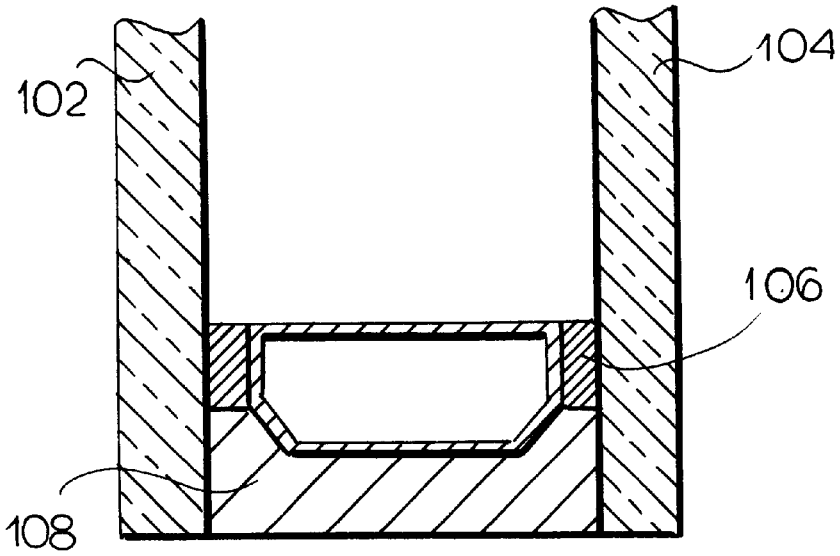
FIG 17 PRIOR ART
FIG. 17 is a peripheral bond of an insulating window unit with the spacer profile of FIG. 16.

An insulating glass pane unit was produced with a conventional metallic spacer according to FIG. 16 and a peripheral seal according to FIG. 17.

The box-like hollow profile consisted of aluminum with a wall thickness of 0.38 mm (manufacturer: e.g. the firm Erbslöh). The profile has a width of 15.5 mm and a height of 6.5 mm. The spacer profile was bonded with the panes with an isobutylene sealing material at the height of the contact surfaces with the panes 102, 104, whereby the adhesive were used according to Example 1. The remaining gap was filled with a polysulfide adhesive 108, the covering of the outer wall thereby amounting to 3 mm.

The heat transport in the area of the peripheral bond was determined for he insulating window units described in Examples 1 to 3 with the assistance of heat flow simulation calculations. With the commercially available software program "WINISO 1.3" of the firm Sommer Informatik GmbH two-dimensional heat fields were calculated. From the representation of the isotherms calculated this way the below-indicated glass surface temperature in the area of the peripheral bond were established. They are a measure for the quality of the heat insulation. Higher temperatures in the peripheral area improve the k-value and therewith the heat barrier of the window and reduce the formation of condensate.

Besides values for which manufacturer specification are available, for this calculations also heat-conduction indications according to DIN 4108 Part 4, respectively according to prEN 30 077 were also included. The data is presented in the following Table 2.

TABLE 2

| Name of Material | Heat conductivity (W/m K) |
|---|---|
| glass | 1.0 |
| aluminum | 220 |
| stainless steel | 15 |
| tin plate | 35* |
| polypropylene | 0.22 |
| polysulfide | 0.19 |
| butyl | 0.24 |
| molecular sieve | 0.13 |
| argon | 0.016 |

*Manufacturer indication

The calculations were performed with the measurement and geometries according to the individual examples, whereby as it was assumed that the external temperature was 0° C. and the internal temperature was 20° C.

The surface temperatures in the area of the peripheral bond on the warm side, respectively 0 mm, 6 mm and 12 mm starting from the glass edge are indicated in Table 3.

TABLE 3

| Spacer | polypropylene + stainless steel | stainless steel + tin plate | aluminum |
|---|---|---|---|
| Surface temp. (° C.) on warm side | | | |
| 0 mm from glass edge | 12.3 | 10.9 | 8.2 |
| 6 mm from glass edge | 12.7 | 11.1 | 8.3 |
| 12 mm from glass edge | 13.5 | 12.5 | 9.8 |

The results make clear the improved heat insulation of the spacer profile according to the present invention over the conventional aluminum spacer profiles. The variant polypropylene with stainless steel foil is thereby particularly suited in cases where a high degree of heat insulating capability is required, while the variant polypropylene with tin plate offers pliability advantages.

Insulating window units according to Example 1 were subjected to tests according to insulation glass standards prEN 1279 Part 2 and Part 3. The requirements regarding long-term behavior, vapor and gas tightness were fully met.

What is claimed is:

1. A spacer profile for a spacer frame to be mounted in the space between panes forming an insulating window unit, said spacer profile comprising a profile body formed with a chamber for receiving hygroscopic material and with at least one contact web for lying against the inside of one of said panes on at least one side of the chamber, said contact web being connected with the chamber via a bridge section, whereby the profile body has at least one outwardly open area with a U-shaped cross section, whose flanks are formed by the contact web and an adjacent side wall of the chamber and a base is formed by the bridge section connecting the same, the profile body of the spacer profile consists of an elastically-plastically deformable material with a heat conduction value of $\lambda<0.3$ W/(mK), the flanks of the area with said U-shaped cross section having a height which is at least twice the width of the base, and that at least the contact web being permanently materially connected with a deformable reinforcement layer made of a metal with a heat conduction value of $\lambda<50$ W/(Mk).

2. The spacer profile according to claim 1 wherein the flanks of the U-shaped cross-sectional area have a height which is at least three times the width of the base.

3. The spacer profile according to claim 2 wherein the flanks have a height which is at least 5 times the width of the base.

4. The spacer profile according to claim 1 wherein the reinforcement layer is arranged on a contact surface of the contact web.

5. The spacer profile according to claim 1 wherein the reinforcement layer is arranged on a chamber-side surface of the contact web.

6. The spacer profile according to claim 1 wherein the profile body is permanently materially connected with a reinforcement layer extending substantially over its entire width and length.

7. The spacer profile according to claim 1 wherein the reinforcement layer is diffusion-tight at least in an area of the walls of the chamber and of the bridge sections.

8. The spacer profile according to claim 1 wherein the reinforcement layer is arranged on the outside of the profile body or at least partially embedded close to the surface of the same.

9. The spacer profile according to claim 1 wherein the reinforcement layer is arranged on a chamber-side surface of the contact web, on an outside of the bridge section connected with the contact web, as well as on an outside of a side wall of the chamber adjacent to the contact web, and the reinforcement layer is diffusion-tight at least in an area of the bridge section and the side wall of the chamber.

10. The spacer profile according to claim 1 wherein the reinforcement layer extends continuously from a contact surface of the contact web over a chamber-side surface thereof, an outer side of the bridge section connected with the contact web, an outer side of a neighboring side wall of the chamber, as well an outer side of an outer wall of the chamber, and the reinforcement layer is diffusion-tight at least in an area of the bridge section and the side wall of the chamber.

11. The spacer profile according to claim 1 wherein the chamber is centrally arranged and on each side of the chamber at least one contact web is provided.

12. The spacer profile according to claim 1 wherein the chamber has a rectangular or trapezoidal cross section.

13. The spacer profile according to claim 1 wherein the bridge section for the connection of at least one contact web is fixed in a corner area of the chamber arranged close to a space between the panes.

14. The spacer profile according to claim 1 wherein the height of the contact web is smaller than or substantially equal to the height of an adjacent side wall of the chamber.

15. The spacer profile according to claim 1 wherein the contact web projects beyond a wall facing towards a space between the panes of the insulating window unit, or towards an outer wall of the chamber opposite thereto.

16. The spacer profile according to claim 1 wherein the contact web is parallel to one side wall of the chamber.

17. The spacer profile according to claim 1 wherein the reinforcement layer consists of tin plate or stainless steel.

18. The spacer profile according to claim 17 wherein the reinforcement layer has a thickness of at least 0.02 mm.

19. The spacer profile according to claim 17 wherein the reinforcement layer of tin plate has a thickness of at least 0.2 mm.

20. The spacer profile defined in claim 19 wherein said thickness is at most 0.13 mm.

21. The spacer profile according to claim 17 wherein the reinforcement layer of stainless steel has a thickness of less than 0.1 mm.

22. The spacer profile defined in claim 21 wherein said thickness is at most 0.05 mm.

23. The spacer profile according to claim 1 wherein the reinforcement layer is provided at least partially on its outside with a protective layer.

24. The spacer profile according to claim 1, wherein a path of higher heat conductivity from one pane to the other, formed by the reinforcement layer, equals at least 1.5 times.

25. The spacer profile according to claim 1 wherein a clear width between the contact web and the neighboring wall of the chamber equals at least 0.5 mm.

26. The spacer profile according to claim 1 where the chamber, the bridge section and the contact web have substantially the same wall thickness.

27. The spacer profile according to claim 1 wherein at least one of the walls (12, 14, 16, 18) of the chamber have a reduced wall thickness with respect to the bridge section and the contact web.

28. The spacer profile according to claim 1 wherein the profile body is made of polypropylene, polyethylene terephthalate, polyamides polycarbonate.

29. An insulating window unit with at least two panes facing each other at a distance and with a spacer frame made of a spacer profile according to claims 1, which together with the panes defines an intermediate pane space, the body having contact webs glued to an inner pane side facing them over substantially their entire length and height by means of a diffusion-tight adhesive and a clear space between the contact webs and the chamber, as well as at least the connection area to the neighboring inner side of the pane being filled with a mechanically stabilizing sealing material.

30. The insulating window unit according to claim 29, wherein the mechanically stabilizing sealing material (108) fills the clear space to the peripheral margins of the insulating window unit completely.

31. The insulating window unit according to claim 29 wherein the mechanically stabilizing sealing material is a sealing agent on a polysulfide, polyurethane or silicon basis.

32. The insulating window unit according claims 31, wherein the contact webs are glued together with the inner side of the panes by means of a butyl sealing material on a basis of polyisobutylene.

* * * * *